United States Patent [19]

Sakai

[11] Patent Number: 4,850,821

[45] Date of Patent: Jul. 25, 1989

[54] MULTIPLE MAGNET DRIVE PUMP

[75] Inventor: Naotake Sakai, Tokyo, Japan

[73] Assignee: Nikkiso Eiko Co., Ltd., Tokyo, Japan

[21] Appl. No.: 166,264

[22] Filed: Mar. 10, 1988

[30] Foreign Application Priority Data

Mar. 13, 1987 [JP] Japan ..... 62-56828

[51] Int. Cl.[4] ..... F04B 35/00

[52] U.S. Cl. ..... 417/420; 416/3; 310/152; 74/DIG. 4; 74/665 G

[58] Field of Search ..... 417/420; 415/60, 170, 415/DIG. 4; 74/DIG. 4, 665 GA, 665 GE, 665 G; 366/245; 310/156, 83, 152, 114, 112

[56] References Cited

U.S. PATENT DOCUMENTS

| | | | |
|---|---|---|---|
| 1,108,991 | 9/1914 | Hyson | 366/245 |
| 1,845,561 | 2/1932 | Runge | 415/60 |
| 2,243,555 | 5/1941 | Faus | 74/DIG. 4 |
| 2,722,617 | 11/1955 | Cluwen | 74/DIG. 4 |
| 3,273,001 | 9/1966 | Baermann | 310/152 |
| 4,018,105 | 4/1977 | Walker | 74/665 GE |
| 4,678,409 | 7/1987 | Kurokawa . | |
| 4,709,587 | 12/1987 | Fiornascent | 74/15.63 |

FOREIGN PATENT DOCUMENTS

| | | | |
|---|---|---|---|
| 55-69358 | 5/1980 | Japan | 74/DIG. 4 |
| 61-285067 | 12/1986 | Japan | 310/152 |
| 319707 | 4/1957 | Switzerland | 74/DIG. 4 |

*Primary Examiner*—Carlton R. Croyle
*Assistant Examiner*—Robert N. Blackman
*Attorney, Agent, or Firm*—Helfgott & Karas

[57] ABSTRACT

A multiple magnet drive pump is disclosed, which includes a driving magnet having opposite polarities circumferentially spaced apart from each other, a plurality of driven magnets on a circumference of the driving magnet for rotation in a non-contact state therewith, and a plurality of pump sections each having the driven magnet incorporated into a rotor for a pumping operation.

1 Claim, 2 Drawing Sheets

MULTIPLE MAGNET DRIVE PUMP

BACKGROUND OF THE INVENTION

FIELD OF THE INVENTION

This invention relates to a magnet drive pump utilizing a magnetic coupling, more particularly to a magnet drive pump which includes a driving magnet and a plurality of driven magnets positioned on the driving magnet and circumferentially spaced apart from each other for effecting a pump action through the rotation of the driving magnet.

A magnet drive pump utilizes a magnetic coupling as a means for transmitting a power of a driving motor to an impeller without any motor-driving shaft through a pump section and thus has an advantage of avoiding leakage of fluid without necessity of utilizing a sealing means, such as a mechanical seal, resulting in a variety of applications.

In conventional apparatus utilizing the magnet drive pump, a plurality of pumps have been required for simultaneous feeding various kinds of liquid. For this purpose, it has been a usual practice to employ a plurality of independent pumps. In such case, especially for a compact apparatus having a less mounting space, a forced cooling means has been required in order to remove an accumulated heat generated by a plurality of electric motors as driving sources for the pumps.

Such problem of the heat generation may be solved by forming a structure of plurality pumps having a single common driving source. For this purpose, the applicant has already developed a multiple magnet drive pump and filed the patent application therefor. The pump disclosed in that application includes a plurality of pump sections each being provided with a rotatable impeller having a driven magnet which is opposed to a magnet driving section of a rotor having a driving magnet with an intervening isolation wall for liquid-tight seal, wherein the pump sections are coupled with an endless belt or with gears in the magnetic driving section, to thereby simultaneously drive the plurality of pump sections by means of a single driving motor.

Such type of the multiple magnet drive pump is effective for saving energy and reducing the heat generation due to utilizing the single driving motor, but requires a mechanical transmission mechanism, such as a belt, gears, a chain or the like, which cause a noise due to slippage of the belt with reduction of a transmission efficiency or it service life due to wearing off of the belt, as well as with troublesome maintenance for lubricating the gears to provide smooth transmission. Further, a rotation rate of the driving magnet to the driven magnet in the pump section should be 1 : 1 and the mechanical transmission mechanism must be arranged, whereby applications for high speed operations are limited.

SUMMARY OF THE INVENTION

Accordingly, an object of the invention is to provide a multiple magnet drive pump which may be operated at the high speed with a considerably reduced noise, friction and heat-generation, and which may facilitate a series, parallel or series/parallel connection of the plurality of pump sections, and thereby enlarge the pumping functions.

In order to achieve the above object, the invention provides a multiplex magnet drive pump, which comprises a driving magnet having opposite polarities circumferentially spaced apart from each other, a plurality of driven magnets arranged around a circumference of the driving magnet for rotation in a non-contact state therewith, and a plurality of pump sections each having the driven magnet incorporated into the rotor for a pumping operation.

In the pump according to the invention, the rotary body having the driven magnet may be arranged either on an outer or inner circumference of the driving magnet.

Further, the driving magnet may be formed of a flexible magnet belt which is arranged on a pair of driving and driven pulleys for its rotation.

Still further, the pump section may be formed by integrally arranging an impeller on one end of the rotor having the driven matnet, and the rotor is then arranged in a rear casing which in turn is enclosed in a pump casing to be fixed to a cover surrounding the driving magnet.

According to the multiple magnet drive pump of the invention, the driving magnet is provided with opposite polarities circumferentially spaced apart from each other, and the plurality of driven magnets are rotatably arranged around the outer or inner circumference of the driving magnet in a non-contact state therewith, so that the movement of the polarity through rotation of the driving magnet may rotate each driven magnet at a rotation rate proportional to the number of poles of the driving magnet and the driven magnets. The construction of each driven magnet as the rotor for the pumping action in each pump section reduces the noise, improves the durability, and permits the econimical operation of the pump and its manufacture at a low cost. The rotation rate of the driving magnet to the driven magnet may be selectively determined, and a conventional transmission mechanism may be avoided, thereby enabling the high speed operation and facilitating the compactness, low cost and easy maintenance of the pump. Further, each of the pump sections may be idependently connecting to each feeding system for a simultaneous feeding of various kinds of liquids. Still further, the pump sections may be connected in series, in parallel or in series/parallel, so that a head and a delivery capacity of the pump may be increased selectively.

The invention will now be described for better understanding with reference to the accompanying drawings.

DETAILED DESCRIPTION OF THE PREFERRED EMBODIMENTS OF THE INVENTION

Figure 1:
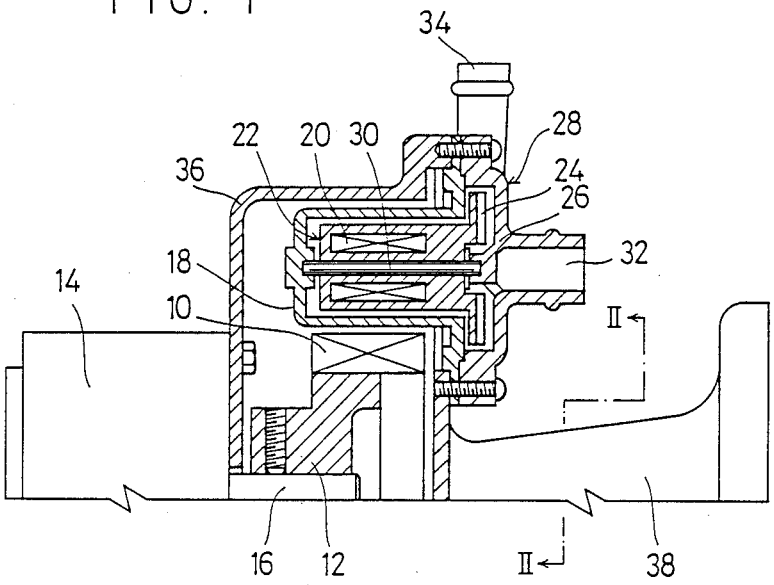
FIG. 1 is a sectional side view of one embodiment of the multiple magnet drive pump according to the invention.
Figure 2:
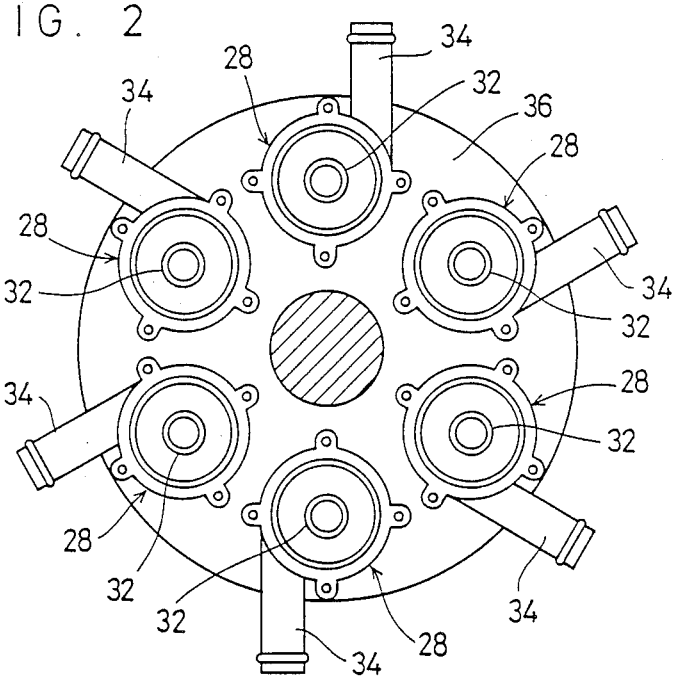
FIG. 2 is a sectional view of the pump taken along line II—II of FIG. 1.

FIGS. 1 and 2 illustrate one embodiment of the multiple magnet drive pump according to the invention. Namely, a sectional front view of a main portion of the inventive pump is shown in FIG. 1, wherein reference 10 represents a driving magnet in the ring form which is provided on its circumference with opposite polarities circumferentially spaced apart from each other at a predetermined distance. The driving magnet 10 is held in contact with an inner magnet holder 12, through a center of which an output shaft 16 of an electric motor 14 is passed and rotatably fixed.

The driving magnet 10 on its outer circumference is provided adjacent thereto with a rear casing 18 which contains a rotor 22 made of a plastic material and having driven magnet 20 therein. The rotor 22 at its one end is enclosed in the rear casing 18 and at its other end is provided integrally with an impeller 24 which in turn is arranged in a pump casing 26, thereby forming a pump section 28. In this case, the rotor 22 is rotatably mounted to a shaft 30 and its one end is supported to the rear casing 18 while at its other end in the pump casing 26 is provided with a suction port 32 and a delivery port 34, respectively, the rear casing 18 and the pump casing 26 for forming the pump section 28 may be optionally fixed to a cover 36 surrounding the driving magnet 10.

As shown in FIG. 2, a plurality of the pump sections 28 thus constructed are arranged symmetrically on the outer circumference of the driving magnet 10 and thus may be simultaneously operated for their pumping action through rotation of the common driving magnet 10. In FIG. 1, reference 38 represents a stand for mounting the pump according to the invention.

Figure 3:
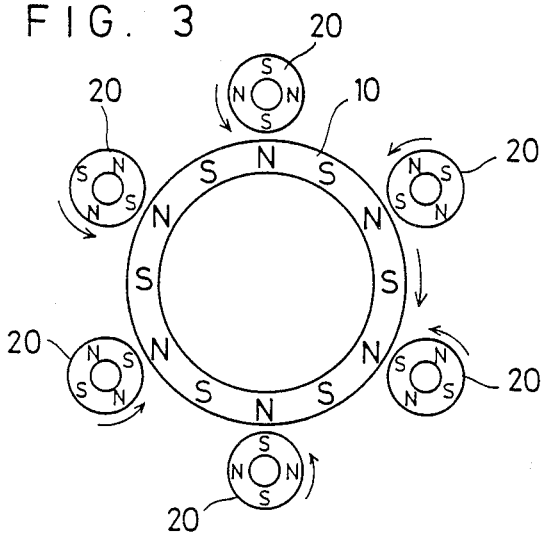
FIG. 3 is a schematic view of the mechanism for the pump driving system of FIG. 1.

FIG. 3 illustrates a mechanism for the driving system including the driving magnet 10 of the above embodiment and the driven magnets 20 forming each pump section. When the driving magnet 10 having polarities as illustrated is rotated in the direction shown by an arrow in FIG. 3, the driven magnets 20 arranged on its outer circumference may be rotated in the direction according to the driving magnet 10. In this case, the driving magnet 10 is not contacted with the driven magnets 20 and the rotor 22 therefor, so that the slipping noise and the service life reduction due to friction may be avoided.

Figure 4:
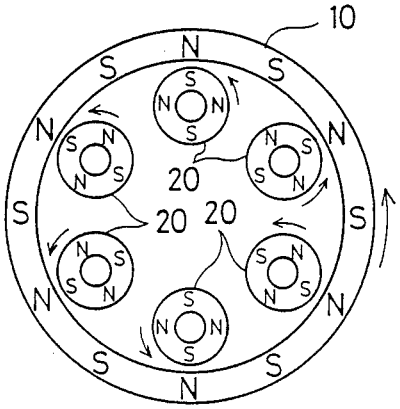
FIG. 4 is a schematic view of the mechanism for the pump driving system of another embodiment of the multiple magnet drive pump according to the invention.

FIG. 4 illustrates a mechanism for the driving system of another embodiment of the pump according to the invention, wherein each of the driving magnets 20 is arranged on the inner circumference of the driving magnet 10 to form the pump section 28. In this embodiment, the pumping operation may be achieved in the same way as in FIG. 3.

Figure 5:
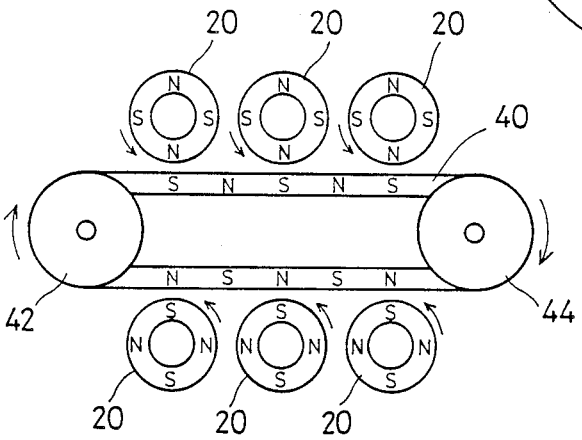
FIG. 5 is a schematic view of the mechanism for the pump driving system in accordance with a further embodiment of the multiple magnet drive pump according to the invention.

FIG. 5 illustrates a mechanism for the driving system of a further embodiment of the pump according to the invention, wherein the driving magnet is constructed with a flexible magnet belt 40 which is wound around a pair of pulleys, namely a driving pulley 42 and a driven pulley 44, to form an endless belt mechanism. In this embodiment, the pump sections 28 may be arranged in parallel, resulting in the smaller space for setting thereof.

Further, in practical use of the pump according to the invention, the plurality of pump sections 28 may be connected selectively and individually to each feeding system for simultaneously feeding the liquid. Alternatively, two or more pump sections 28 may be connected in series to achieve a multiple head depending on the number of the connected pump sections. The parallel connection of two or more pump sections 28, on the other hand, may achieve a multiple delivery capacity depending on the number of connected pump sections 28. Thus, the pump sections may be optionally connected to a single feeding system either in series or in parallel, so that the head and the delivery capacity may be variably determined depending on a variety of piping connections resulting in the excellent pumping operation with a high efficiency.

As described herein-above, in accordance with the invention, the single driving magnet and the driving electric motor therefor may be provided independently of the pump sections for simultaneously rotating a plurality of the driven magnets forming the rotor each having the pumping function, so that the slipping noise and the damage due to wear in the conventional transmission mechanism may be surely avoided.

Further, the electric motor for the driving magnet may be sufficiently spaced apart from the pump sections, so that the motor of a higher power may be utilized without any adverse thermal effect.

In particular, the pump sections may be used individually, or connected in series, in parallel or in series/parallel for achieving a variety of applications with different delivery capacity or heads.

Furthermore, the structure of the pump sections may be simplified at a low manufacturing cost, and improve its maintenance and durability, thereby considerably enlarging practical applications.

What is claimed is:

1. A multiple magnet drive pump, which comprises a driving magnet having opposite polarities circumferentially spaced apart from each other, a plurality of driven magnets arranged at an outer circumference of said driving magnet for rotation in a non-contact relationship therewith, and a plurality of pump sections each having said driven magnet enclosed in a rotor for pumping operations, each pump section being formed by integrally providing an impeller on one end of the rotor enclosing the driven magnet, said rotor being arranged in a rear casing and a pump casing, said rotor being rotatably supported at two opposite ends thereof in said rear casing and said pump casing, respectively, said driving magnet being surrounded by a cover, said rear casing and said pump casing being fixed to said cover.

* * * * *